US010640325B2

(12) United States Patent
Yap

(10) Patent No.: US 10,640,325 B2
(45) Date of Patent: May 5, 2020

(54) RIGID YET FLEXIBLE SPINDLE FOR ROLLED MATERIAL

(71) Applicant: Datamax-O'Neil Corporation, Orlando, FL (US)

(72) Inventor: Yaw Horng Yap, Singapore (SG)

(73) Assignee: DATAMAX-O'NEIL CORPORATION, Orlando, FL (US)

( * ) Notice: Subject to any disclaimer, the term of this patent is extended or adjusted under 35 U.S.C. 154(b) by 0 days.

(21) Appl. No.: 15/229,379

(22) Filed: Aug. 5, 2016

(65) Prior Publication Data

US 2018/0037434 A1 Feb. 8, 2018

(51) Int. Cl.
*B65H 75/24* (2006.01)

(52) U.S. Cl.
CPC ..... *B65H 75/245* (2013.01); *B65H 2701/192* (2013.01)

(58) Field of Classification Search
CPC ..... B65H 75/245; B65H 75/248; B65H 2701/192
See application file for complete search history.

(56) References Cited

U.S. PATENT DOCUMENTS

| | | | | |
|---|---|---|---|---|
| 1,006,072 | A | 10/1911 | Henry, Jr. | |
| 5,947,409 | A * | 9/1999 | Corrigan, Jr. | B65H 75/08 242/422.4 |
| 6,425,548 | B2 * | 7/2002 | Christensen | B65H 75/08 242/571.4 |
| 6,832,725 | B2 | 12/2004 | Gardiner et al. | |
| 7,128,266 | B2 | 10/2006 | Zhu et al. | |
| 7,159,783 | B2 | 1/2007 | Walczyk et al. | |
| 7,413,127 | B2 | 8/2008 | Ehrhart et al. | |
| 7,726,575 | B2 | 6/2010 | Wang et al. | |
| 7,905,444 | B2 | 3/2011 | Chen | |
| 8,294,969 | B2 | 10/2012 | Plesko | |
| 8,317,105 | B2 | 11/2012 | Kotlarsky et al. | |
| 8,322,622 | B2 | 12/2012 | Liu | |
| 8,366,005 | B2 | 2/2013 | Kotlarsky et al. | |
| 8,371,507 | B2 | 2/2013 | Haggerty et al. | |
| 8,376,233 | B2 | 2/2013 | Van Horn et al. | |
| 8,381,979 | B2 | 2/2013 | Franz | |
| 8,390,909 | B2 | 3/2013 | Plesko | |

(Continued)

FOREIGN PATENT DOCUMENTS

| | | | |
|---|---|---|---|
| WO | 2013163789 | A1 | 11/2013 |
| WO | 2013173985 | A1 | 11/2013 |

(Continued)

OTHER PUBLICATIONS

U.S. Appl. No. 13/367,978, filed Feb. 7, 2012, (Feng et al.); now abandoned.

(Continued)

*Primary Examiner* — Sang K Kim
(74) *Attorney, Agent, or Firm* — Alston & Bird LLP

(57) ABSTRACT

Embodiments of the present invention describe a spindle for use by rolled materials (for example, ribbon, and labels) in a thermal printing device. The spindle contains a rigid side designed to prevent the spindle from flexing during printing. The spindle also contains a flexible side designed to address tolerance issues with the core of the rolled material and to retain the relative movement of the core of the rolled material.

19 Claims, 4 Drawing Sheets

(56) References Cited

U.S. PATENT DOCUMENTS 8,408,464 B2 4/2013 Zhu et al.
8,408,468 B2 4/2013 Horn et al.
8,408,469 B2 4/2013 Good
8,424,768 B2 4/2013 Rueblinger et al.
8,448,863 B2 5/2013 Xian et al.
8,457,013 B2 6/2013 Essinger et al.
8,459,557 B2 6/2013 Havens et al.
8,469,272 B2 6/2013 Kearney
8,474,712 B2 7/2013 Kearney et al.
8,479,992 B2 7/2013 Kotlarsky et al.
8,490,877 B2 7/2013 Kearney
8,517,271 B2 8/2013 Kotlarsky et al.
8,523,076 B2 9/2013 Good
8,528,818 B2 9/2013 Ehrhart et al.
8,544,737 B2 10/2013 Gomez et al.
8,548,420 B2 10/2013 Grunow et al.
8,550,335 B2 10/2013 Samek et al.
8,550,354 B2 10/2013 Gannon et al.
8,550,357 B2 10/2013 Kearney
8,556,174 B2 10/2013 Kosecki et al.
8,556,176 B2 10/2013 Van Horn et al.
8,556,177 B2 10/2013 Hussey et al.
8,559,767 B2 10/2013 Barber et al.
8,561,895 B2 10/2013 Gomez et al.
8,561,903 B2 10/2013 Sauerwein
8,561,905 B2 10/2013 Edmonds et al.
8,565,107 B2 10/2013 Pease et al.
8,571,307 B2 10/2013 Li et al.
8,579,200 B2 11/2013 Samek et al.
8,583,924 B2 11/2013 Caballero et al.
8,584,945 B2 11/2013 Wang et al.
8,587,595 B2 11/2013 Wang
8,587,697 B2 11/2013 Hussey et al.
8,588,869 B2 11/2013 Sauerwein, Jr. et al.
8,590,789 B2 11/2013 Nahill et al.
8,596,539 B2 12/2013 Havens et al.
8,596,542 B2 12/2013 Havens et al.
8,596,543 B2 12/2013 Havens et al.
8,599,271 B2 12/2013 Havens et al.
8,599,957 B2 12/2013 Peake et al.
8,600,158 B2 12/2013 Li et al.
8,600,167 B2 12/2013 Showering
8,602,309 B2 12/2013 Longacre et al.
8,608,053 B2 12/2013 Meier et al.
8,608,071 B2 12/2013 Liu et al.
8,611,309 B2 12/2013 Wang et al.
8,615,487 B2 12/2013 Gomez et al.
8,621,123 B2 12/2013 Caballero
8,622,303 B2 1/2014 Meier et al.
8,628,013 B2 1/2014 Ding
8,628,015 B2 1/2014 Wang et al.
8,628,016 B2 1/2014 Winegar
8,629,926 B2 1/2014 Wang
8,630,491 B2 1/2014 Longacre et al.
8,635,309 B2 1/2014 Berthiaume et al.
8,636,200 B2 1/2014 Kearney
8,636,212 B2 1/2014 Nahill et al.
8,636,215 B2 1/2014 Ding et al.
8,636,224 B2 1/2014 Wang
8,638,806 B2 1/2014 Wang et al.
8,640,958 B2 2/2014 Lu et al.
8,640,960 B2 2/2014 Wang et al.
8,643,717 B2 2/2014 Li et al.
8,646,692 B2 2/2014 Meier et al.
8,646,694 B2 2/2014 Wang et al.
8,646,988 B2 2/2014 Tanaka
8,657,200 B2 2/2014 Ren et al.
8,659,397 B2 2/2014 Vargo et al.
8,668,149 B2 3/2014 Good
8,678,285 B2 3/2014 Kearney
8,678,286 B2 3/2014 Smith et al.
8,682,077 B1 3/2014 Longacre
D702,237 S 4/2014 Oberpriller et al.
8,687,282 B2 4/2014 Feng et al.
8,692,927 B2 4/2014 Pease et al.
8,695,880 B2 4/2014 Bremer et al.
8,698,949 B2 4/2014 Grunow et al.
8,702,000 B2 4/2014 Barber et al.
8,717,494 B2 5/2014 Gannon
8,720,783 B2 5/2014 Biss et al.
8,723,804 B2 5/2014 Fletcher et al.
8,723,904 B2 5/2014 Marty et al.
8,727,223 B2 5/2014 Wang
8,740,082 B2 6/2014 Wilz
8,740,085 B2 6/2014 Furlong et al.
8,746,563 B2 6/2014 Hennick et al.
8,750,445 B2 6/2014 Peake et al.
8,752,766 B2 6/2014 Xian et al.
8,756,059 B2 6/2014 Braho et al.
8,757,495 B2 6/2014 Qu et al.
8,760,563 B2 6/2014 Koziol et al.
8,763,909 B2 7/2014 Reed et al.
8,777,108 B2 7/2014 Coyle
8,777,109 B2 7/2014 Oberpriller et al.
8,779,898 B2 7/2014 Havens et al.
8,781,520 B2 7/2014 Payne et al.
8,783,573 B2 7/2014 Havens et al.
8,789,757 B2 7/2014 Barten
8,789,758 B2 7/2014 Hawley et al.
8,789,759 B2 7/2014 Xian et al.
8,794,520 B2 8/2014 Wang et al.
8,794,522 B2 8/2014 Ehrhart
8,794,525 B2 8/2014 Amundsen et al.
8,794,526 B2 8/2014 Wang et al.
8,798,367 B2 8/2014 Ellis
8,807,431 B2 8/2014 Wang et al.
8,807,432 B2 8/2014 Van Horn et al.
8,820,630 B2 9/2014 Qu et al.
8,822,848 B2 9/2014 Meagher
8,824,692 B2 9/2014 Sheerin et al.
8,824,696 B2 9/2014 Braho
8,842,849 B2 9/2014 Wahl et al.
8,844,822 B2 9/2014 Kotlarsky et al.
8,844,823 B2 9/2014 Fritz et al.
8,849,019 B2 9/2014 Li et al.
D716,285 S 10/2014 Chaney et al.
8,851,383 B2 10/2014 Yeakley et al.
8,854,633 B2 10/2014 Laffargue
8,866,963 B2 10/2014 Grunow et al.
8,868,421 B2 10/2014 Braho et al.
8,868,519 B2 10/2014 Maloy et al.
8,868,802 B2 10/2014 Barten
8,868,803 B2 10/2014 Caballero
8,870,074 B1 10/2014 Gannon
8,879,639 B2 11/2014 Sauerwein
8,880,426 B2 11/2014 Smith
8,881,983 B2 11/2014 Havens et al.
8,881,987 B2 11/2014 Wang
8,903,172 B2 12/2014 Smith
8,908,995 B2 12/2014 Benos et al.
8,910,870 B2 12/2014 Li et al.
8,910,875 B2 12/2014 Ren et al.
8,914,290 B2 12/2014 Hendrickson et al.
8,914,788 B2 12/2014 Pettinelli et al.
8,915,439 B2 12/2014 Feng et al.
8,915,444 B2 12/2014 Havens et al.
8,916,789 B2 12/2014 Woodburn
8,918,250 B2 12/2014 Hollifield
8,918,564 B2 12/2014 Caballero
8,925,818 B2 1/2015 Kosecki et al.
8,939,374 B2 1/2015 Jovanovski et al.
8,942,480 B2 1/2015 Ellis
8,944,313 B2 2/2015 Williams et al.
8,944,327 B2 2/2015 Meier et al.
8,944,332 B2 2/2015 Harding et al.
8,950,678 B2 2/2015 Germaine et al.
D723,560 S 3/2015 Zhou et al.
8,967,468 B2 3/2015 Gomez et al.
8,971,346 B2 3/2015 Sevier
8,976,030 B2 3/2015 Cunningham et al.
8,976,368 B2 3/2015 Akel et al.
8,978,981 B2 3/2015 Guan
8,978,983 B2 3/2015 Bremer et al.
8,978,984 B2 3/2015 Hennick et al.

(56) References Cited

U.S. PATENT DOCUMENTS

| | | | |
|---|---|---|---|
| 8,985,456 | B2 | 3/2015 | Zhu et al. |
| 8,985,457 | B2 | 3/2015 | Soule et al. |
| 8,985,459 | B2 | 3/2015 | Kearney et al. |
| 8,985,461 | B2 | 3/2015 | Gelay et al. |
| 8,988,578 | B2 | 3/2015 | Showering |
| 8,988,590 | B2 | 3/2015 | Gillet et al. |
| 8,991,704 | B2 | 3/2015 | Hopper et al. |
| 8,996,194 | B2 | 3/2015 | Davis et al. |
| 8,996,384 | B2 | 3/2015 | Funyak et al. |
| 8,998,091 | B2 | 4/2015 | Edmonds et al. |
| 9,002,641 | B2 | 4/2015 | Showering |
| 9,007,368 | B2 | 4/2015 | Laffargue et al. |
| 9,010,641 | B2 | 4/2015 | Qu et al. |
| 9,015,513 | B2 | 4/2015 | Murawski et al. |
| 9,016,576 | B2 | 4/2015 | Brady et al. |
| D730,357 | S | 5/2015 | Fitch et al. |
| 9,022,288 | B2 | 5/2015 | Nahill et al. |
| 9,030,964 | B2 | 5/2015 | Essinger et al. |
| 9,033,240 | B2 | 5/2015 | Smith et al. |
| 9,033,242 | B2 | 5/2015 | Gillet et al. |
| 9,036,054 | B2 | 5/2015 | Koziol et al. |
| 9,037,344 | B2 | 5/2015 | Chamberlin |
| 9,038,911 | B2 | 5/2015 | Xian et al. |
| 9,038,915 | B2 | 5/2015 | Smith |
| D730,901 | S | 6/2015 | Oberpriller et al. |
| D730,902 | S | 6/2015 | Fitch et al. |
| D733,112 | S | 6/2015 | Chaney et al. |
| 9,047,098 | B2 | 6/2015 | Barten |
| 9,047,359 | B2 | 6/2015 | Caballero et al. |
| 9,047,420 | B2 | 6/2015 | Caballero |
| 9,047,525 | B2 | 6/2015 | Barber |
| 9,047,531 | B2 | 6/2015 | Showering et al. |
| 9,049,640 | B2 | 6/2015 | Wang et al. |
| 9,053,055 | B2 | 6/2015 | Caballero |
| 9,053,378 | B1 | 6/2015 | Hou et al. |
| 9,053,380 | B2 | 6/2015 | Xian et al. |
| 9,057,641 | B2 | 6/2015 | Amundsen et al. |
| 9,058,526 | B2 | 6/2015 | Powilleit |
| 9,064,165 | B2 | 6/2015 | Havens et al. |
| 9,064,167 | B2 | 6/2015 | Xian et al. |
| 9,064,168 | B2 | 6/2015 | Todeschini et al. |
| 9,064,254 | B2 | 6/2015 | Todeschini et al. |
| 9,066,032 | B2 | 6/2015 | Wang |
| 9,070,032 | B2 | 6/2015 | Corcoran |
| D734,339 | S | 7/2015 | Zhou et al. |
| D734,751 | S | 7/2015 | Oberpriller et al. |
| 9,082,023 | B2 | 7/2015 | Feng et al. |
| 9,171,539 | B2 | 10/2015 | Funyak et al. |
| 9,224,022 | B2 | 12/2015 | Ackley et al. |
| 9,224,027 | B2 | 12/2015 | Van Horn et al. |
| D747,321 | S | 1/2016 | London et al. |
| 9,230,140 | B1 | 1/2016 | Ackley |
| 9,443,123 | B2 | 1/2016 | Hejl |
| 9,250,712 | B1 | 2/2016 | Todeschini |
| 9,258,033 | B2 | 2/2016 | Showering |
| 9,261,398 | B2 | 2/2016 | Amundsen et al. |
| 9,262,633 | B1 | 2/2016 | Todeschini et al. |
| 9,262,662 | B2 | 2/2016 | Chen et al. |
| 9,262,664 | B2 | 2/2016 | Soule et al. |
| 9,274,806 | B2 | 3/2016 | Barten |
| 9,282,501 | B2 | 3/2016 | Wang et al. |
| 9,292,969 | B2 | 3/2016 | Laffargue et al. |
| 9,298,667 | B2 | 3/2016 | Caballero |
| 9,310,609 | B2 | 4/2016 | Rueblinger et al. |
| 9,319,548 | B2 | 4/2016 | Showering et al. |
| D757,009 | S | 5/2016 | Oberpriller et al. |
| 9,342,724 | B2 | 5/2016 | McCloskey |
| 9,342,827 | B2 | 5/2016 | Smith |
| 9,355,294 | B2 | 5/2016 | Smith et al. |
| 9,367,722 | B2 | 6/2016 | Xian et al. |
| 9,373,018 | B2 | 6/2016 | Colavito et al. |
| 9,375,945 | B1 | 6/2016 | Bowles |
| D760,719 | S | 7/2016 | Zhou et al. |
| 9,390,596 | B1 | 7/2016 | Todeschini |
| 9,396,375 | B2 | 7/2016 | Qu et al. |
| 9,398,008 | B2 | 7/2016 | Todeschini et al. |
| D762,604 | S | 8/2016 | Fitch et al. |
| D762,647 | S | 8/2016 | Fitch et al. |
| 9,405,011 | B2 | 8/2016 | Showering |
| 9,407,840 | B2 | 8/2016 | Wang |
| 9,412,242 | B2 | 8/2016 | Van Horn et al. |
| 9,418,252 | B2 | 8/2016 | Nahill et al. |
| D766,244 | S | 9/2016 | Zhou et al. |
| 9,443,222 | B2 | 9/2016 | Singel et al. |
| 9,448,610 | B2 | 9/2016 | Davis et al. |
| 9,478,113 | B2 | 10/2016 | Xie et al. |
| 9,557,166 | B2 | 1/2017 | Thuries et al. |
| 9,564,035 | B2 | 2/2017 | Ackley et al. |
| 9,582,696 | B2 | 2/2017 | Barber et al. |
| 9,616,749 | B2 | 4/2017 | Chamberlin |
| 9,618,993 | B2 | 4/2017 | Murawski et al. |
| 9,659,183 | B2 | 5/2017 | Zhu et al. |
| 9,665,757 | B2 | 5/2017 | Feng et al. |
| 9,715,614 | B2 | 7/2017 | Todeschini et al. |
| 9,734,493 | B2 | 8/2017 | Gomez et al. |
| 9,752,864 | B2 | 9/2017 | Laffargue et al. |
| 9,762,793 | B2 | 9/2017 | Ackley et al. |
| 9,767,581 | B2 | 9/2017 | Todeschini |
| 9,794,392 | B2 | 10/2017 | Hejl |
| 9,823,059 | B2 | 11/2017 | Li et al. |
| 9,852,102 | B2 | 12/2017 | Kohtz et al. |
| 9,861,182 | B2 | 1/2018 | Oberpriller et al. |
| 9,897,434 | B2 | 2/2018 | Ackley et al. |
| 9,924,006 | B2 | 3/2018 | Schoon et al. |
| 9,930,050 | B2 | 3/2018 | Yeakley et al. |
| 9,984,685 | B2 | 5/2018 | Braho et al. |
| 10,019,334 | B2 | 7/2018 | Caballero et al. |
| 10,021,043 | B2 | 7/2018 | Sevier |
| 10,060,729 | B2 | 8/2018 | Laffargue et al. |
| 10,121,466 | B2 | 11/2018 | Pecorari |
| 10,139,495 | B2 | 11/2018 | Payne |
| 10,269,342 | B2 | 4/2019 | Braho et al. |
| 10,327,158 | B2 | 6/2019 | Wang et al. |
| 10,410,029 | B2 | 9/2019 | Powilleit |
| 2007/0063048 | A1 | 3/2007 | Havens et al. |
| 2009/0134221 | A1 | 5/2009 | Zhu et al. |
| 2009/0308968 | A1 | 12/2009 | Piotrowski et al. |
| 2010/0177076 | A1 | 7/2010 | Essinger et al. |
| 2010/0177080 | A1 | 7/2010 | Essinger et al. |
| 2010/0177707 | A1 | 7/2010 | Essinger et al. |
| 2010/0177749 | A1 | 7/2010 | Essinger et al. |
| 2010/0265880 | A1 | 10/2010 | Rautiola et al. |
| 2011/0169999 | A1 | 7/2011 | Grunow et al. |
| 2011/0202554 | A1 | 8/2011 | Powilleit et al. |
| 2012/0018565 | A1 | 1/2012 | Weber |
| 2012/0111946 | A1 | 5/2012 | Golant |
| 2012/0168512 | A1 | 7/2012 | Kotlarsky et al. |
| 2012/0193423 | A1 | 8/2012 | Samek |
| 2012/0203647 | A1 | 8/2012 | Smith |
| 2012/0223141 | A1 | 9/2012 | Good et al. |
| 2013/0043312 | A1 | 2/2013 | Van Horn |
| 2013/0075168 | A1 | 3/2013 | Amundsen et al. |
| 2013/0175341 | A1 | 7/2013 | Kearney et al. |
| 2013/0175343 | A1 | 7/2013 | Good |
| 2013/0257744 | A1 | 10/2013 | Daghigh et al. |
| 2013/0257759 | A1 | 10/2013 | Daghigh |
| 2013/0270346 | A1 | 10/2013 | Xian et al. |
| 2013/0287258 | A1 | 10/2013 | Kearney |
| 2013/0292475 | A1 | 11/2013 | Kotlarsky et al. |
| 2013/0292477 | A1 | 11/2013 | Hennick et al. |
| 2013/0293539 | A1 | 11/2013 | Hunt et al. |
| 2013/0293540 | A1 | 11/2013 | Laffargue et al. |
| 2013/0306728 | A1 | 11/2013 | Thuries et al. |
| 2013/0306731 | A1 | 11/2013 | Pedraro |
| 2013/0307964 | A1 | 11/2013 | Bremer et al. |
| 2013/0308625 | A1 | 11/2013 | Park et al. |
| 2013/0313324 | A1 | 11/2013 | Koziol et al. |
| 2013/0313325 | A1 | 11/2013 | Wilz et al. |
| 2013/0342717 | A1 | 12/2013 | Havens et al. |
| 2014/0001267 | A1 | 1/2014 | Giordano et al. |
| 2014/0002828 | A1 | 1/2014 | Laffargue et al. |
| 2014/0008439 | A1 | 1/2014 | Wang |
| 2014/0025584 | A1 | 1/2014 | Liu et al. |
| 2014/0100813 | A1 | 1/2014 | Showering |

(56) References Cited

U.S. PATENT DOCUMENTS

2014/0034734 A1 2/2014 Sauerwein
2014/0036848 A1 2/2014 Pease et al.
2014/0039693 A1 2/2014 Havens et al.
2014/0042814 A1 2/2014 Kather et al.
2014/0049120 A1 2/2014 Kohtz et al.
2014/0049635 A1 2/2014 Laffargue et al.
2014/0061306 A1 3/2014 Wu et al.
2014/0063289 A1 3/2014 Hussey et al.
2014/0066136 A1 3/2014 Sauerwein et al.
2014/0067692 A1 3/2014 Ye et al.
2014/0070005 A1 3/2014 Nahill et al.
2014/0071840 A1 3/2014 Venancio
2014/0074746 A1 3/2014 Wang
2014/0076974 A1 3/2014 Havens et al.
2014/0078341 A1 3/2014 Havens et al.
2014/0078342 A1 3/2014 Li et al.
2014/0078345 A1 3/2014 Showering
2014/0098792 A1 4/2014 Wang et al.
2014/0100774 A1 4/2014 Showering
2014/0103115 A1 4/2014 Meier et al.
2014/0104413 A1 4/2014 McCloskey et al.
2014/0104414 A1 4/2014 McCloskey et al.
2014/0104416 A1 4/2014 Giordano et al.
2014/0104451 A1 4/2014 Todeschini et al.
2014/0106594 A1 4/2014 Skvoretz
2014/0106725 A1 4/2014 Sauerwein
2014/0108010 A1 4/2014 Maltseff et al.
2014/0108402 A1 4/2014 Gomez et al.
2014/0108682 A1 4/2014 Caballero
2014/0110485 A1 4/2014 Toa et al.
2014/0114530 A1 4/2014 Fitch et al.
2014/0124577 A1 5/2014 Wang et al.
2014/0124579 A1 5/2014 Ding
2014/0125842 A1 5/2014 Winegar
2014/0125853 A1 5/2014 Wang
2014/0125999 A1 5/2014 Longacre et al.
2014/0129378 A1 5/2014 Richardson
2014/0131438 A1 5/2014 Keamey
2014/0131441 A1 5/2014 Nahill et al.
2014/0131443 A1 5/2014 Smith
2014/0131444 A1 5/2014 Wang
2014/0131445 A1 5/2014 Ding et al.
2014/0131448 A1 5/2014 Xian et al.
2014/0133379 A1 5/2014 Wang et al.
2014/0136208 A1 5/2014 Maltseff et al.
2014/0140585 A1 5/2014 Wang
2014/0151453 A1 6/2014 Meier et al.
2014/0152882 A1 6/2014 Samek et al.
2014/0158770 A1 6/2014 Sevier et al.
2014/0159869 A1 6/2014 Zumsteg et al.
2014/0166755 A1 6/2014 Liu et al.
2014/0166757 A1 6/2014 Smith
2014/0166759 A1 6/2014 Liu et al.
2014/0168787 A1 6/2014 Wang et al.
2014/0175165 A1 6/2014 Havens et al.
2014/0175172 A1 6/2014 Jovanovski et al.
2014/0191644 A1 7/2014 Chaney
2014/0191913 A1 7/2014 Ge et al.
2014/0197238 A1 7/2014 Lui et al.
2014/0197239 A1 7/2014 Havens et al.
2014/0197304 A1 7/2014 Feng et al.
2014/0203087 A1 7/2014 Smith et al.
2014/0204268 A1 7/2014 Grunow et al.
2014/0214631 A1 7/2014 Hansen
2014/0217166 A1 8/2014 Berthiaume et al.
2014/0217180 A1 8/2014 Liu
2014/0231500 A1 8/2014 Ehrhart et al.
2014/0232930 A1 8/2014 Anderson
2014/0247315 A1 9/2014 Marty et al.
2014/0263493 A1 9/2014 Amurgis et al.
2014/0263645 A1 9/2014 Smith et al.
2014/0267609 A1 9/2014 Laffargue
2014/0270196 A1 9/2014 Braho et al.
2014/0270229 A1 9/2014 Braho
2014/0278387 A1 9/2014 DiGregorio
2014/0278391 A1 9/2014 Braho et al.
2014/0282210 A1 9/2014 Bianconi
2014/0284384 A1 9/2014 Lu et al.
2014/0288933 A1 9/2014 Braho et al.
2014/0297058 A1 10/2014 Barker et al.
2014/0299665 A1 10/2014 Barber et al.
2014/0312121 A1 10/2014 Lu et al.
2014/0319220 A1 10/2014 Coyle
2014/0319221 A1 10/2014 Oberpriller et al.
2014/0326787 A1 11/2014 Barten
2014/0332590 A1 11/2014 Wang et al.
2014/0344943 A1 11/2014 Todeschini et al.
2014/0346233 A1 11/2014 Liu et al.
2014/0351317 A1 11/2014 Smith et al.
2014/0353373 A1 12/2014 Van Horn et al.
2014/0361073 A1 12/2014 Qu et al.
2014/0361082 A1 12/2014 Xian et al.
2014/0362184 A1 12/2014 Jovanovski et al.
2014/0363015 A1 12/2014 Braho
2014/0369511 A1 12/2014 Sheerin et al.
2014/0374483 A1 12/2014 Lu
2014/0374485 A1 12/2014 Xian et al.
2015/0001301 A1 1/2015 Ouyang
2015/0001304 A1 1/2015 Todeschini
2015/0003673 A1 1/2015 Fletcher
2015/0009338 A1 1/2015 Laffargue et al.
2015/0009610 A1 1/2015 London et al.
2015/0014416 A1 1/2015 Kotlarsky et al.
2015/0021397 A1 1/2015 Rueblinger et al.
2015/0028102 A1 1/2015 Ren et al.
2015/0028103 A1 1/2015 Jiang
2015/0028104 A1 1/2015 Ma et al.
2015/0029002 A1 1/2015 Yeakley et al.
2015/0032709 A1 1/2015 Maloy et al.
2015/0039309 A1 2/2015 Braho et al.
2015/0040378 A1 2/2015 Saber et al.
2015/0048168 A1 2/2015 Fritz et al.
2015/0049347 A1 2/2015 Laffargue et al.
2015/0051992 A1 2/2015 Smith
2015/0053766 A1 2/2015 Havens et al.
2015/0053768 A1 2/2015 Wang et al.
2015/0053769 A1 2/2015 Thuries et al.
2015/0062366 A1 3/2015 Liu et al.
2015/0063215 A1 3/2015 Wang
2015/0063676 A1 3/2015 Lloyd et al.
2015/0069130 A1 3/2015 Gannon
2015/0071819 A1 3/2015 Todeschini
2015/0083800 A1 3/2015 Li et al.
2015/0086114 A1 3/2015 Todeschini
2015/0088522 A1 3/2015 Hendrickson et al.
2015/0096872 A1 4/2015 Woodburn
2015/0099557 A1 4/2015 Pettinelli et al.
2015/0100196 A1 4/2015 Hollifield
2015/0102109 A1 4/2015 Huck
2015/0115035 A1 4/2015 Meier et al.
2015/0127791 A1 5/2015 Kosecki et al.
2015/0128116 A1 5/2015 Chen et al.
2015/0129659 A1 5/2015 Feng et al.
2015/0133047 A1 5/2015 Smith et al.
2015/0134470 A1 5/2015 Hejl et al.
2015/0136851 A1 5/2015 Harding et al.
2015/0136854 A1 5/2015 Lu et al.
2015/0142492 A1 5/2015 Kumar
2015/0144692 A1 5/2015 Hejl
2015/0144698 A1 5/2015 Teng et al.
2015/0144701 A1 5/2015 Xian et al.
2015/0149946 A1 5/2015 Benos et al.
2015/0161429 A1 6/2015 Xian
2015/0169925 A1 6/2015 Chang et al.
2015/0169929 A1 6/2015 Williams et al.
2015/0178523 A1 6/2015 Gelay et al.
2015/0178534 A1 6/2015 Jovanovski et al.
2015/0178535 A1 6/2015 Bremer et al.
2015/0178536 A1 6/2015 Hennick et al.
2015/0178537 A1 6/2015 El et al.
2015/0181093 A1 6/2015 Zhu et al.
2015/0181109 A1 6/2015 Gillet et al.
2015/0186703 A1 7/2015 Chen et al.
2015/0193644 A1 7/2015 Kearney et al.

(56) References Cited

U.S. PATENT DOCUMENTS

| | | | |
|---|---|---|---|
| 2015/0193645 | A1 | 7/2015 | Colavito et al. |
| 2015/0199957 | A1 | 7/2015 | Funyak et al. |
| 2015/0204671 | A1 | 7/2015 | Showering |
| 2015/0210199 | A1 | 7/2015 | Payne |
| 2015/0220753 | A1 | 8/2015 | Zhu et al. |
| 2015/0254485 | A1 | 9/2015 | Feng et al. |
| 2015/0327012 | A1 | 11/2015 | Bian et al. |
| 2016/0014251 | A1 | 1/2016 | Hejl |
| 2016/0040982 | A1 | 2/2016 | Li et al. |
| 2016/0042241 | A1 | 2/2016 | Todeschini |
| 2016/0057230 | A1 | 2/2016 | Todeschini et al. |
| 2016/0109219 | A1 | 4/2016 | Ackley et al. |
| 2016/0109220 | A1 | 4/2016 | Laffargue |
| 2016/0109224 | A1 | 4/2016 | Thuries et al. |
| 2016/0112631 | A1 | 4/2016 | Ackley et al. |
| 2016/0112643 | A1 | 4/2016 | Laffargue et al. |
| 2016/0124516 | A1 | 5/2016 | Schoon et al. |
| 2016/0125217 | A1 | 5/2016 | Todeschini |
| 2016/0125342 | A1 | 5/2016 | Miller et al. |
| 2016/0133253 | A1 | 5/2016 | Braho et al. |
| 2016/0171720 | A1 | 6/2016 | Todeschini |
| 2016/0178479 | A1 | 6/2016 | Goldsmith |
| 2016/0180678 | A1 | 6/2016 | Ackley et al. |
| 2016/0189087 | A1 | 6/2016 | Morton et al. |
| 2016/0125873 | A1 | 7/2016 | Braho et al. |
| 2016/0227912 | A1 | 8/2016 | Oberpriller et al. |
| 2016/0232891 | A1 | 8/2016 | Pecorari |
| 2016/0292477 | A1 | 10/2016 | Bidwell |
| 2016/0294779 | A1 | 10/2016 | Yeakley et al. |
| 2016/0306769 | A1 | 10/2016 | Kohtz et al. |
| 2016/0314276 | A1 | 10/2016 | Sewell et al. |
| 2016/0314294 | A1 | 10/2016 | Kubler et al. |

FOREIGN PATENT DOCUMENTS

| | | | |
|---|---|---|---|
| WO | 2014019130 | A1 | 2/2014 |
| WO | 2014110495 | A1 | 7/2014 |

OTHER PUBLICATIONS

U.S. Appl. No. 14/277,337 for Multipurpose Optical Reader, filed May 14, 2014 (Jovanovski et al.); 59 pages; now abandoned.
U.S. Appl. No. 14/446,391 for Multifunction Point of Sale Apparatus With Optical Signature Capture filed Jul. 30, 2014 (Good et al.); 37 pages; now abandoned.
U.S. Appl. No. 29/516,892 for Table Computer filed Feb. 6, 2015 (Bidwell et al.); 13 pages.
U.S. Appl. No. 29/523,098 for Handle for a Tablet Computer filed Apr. 7, 2015 (Bidwell et al.); 17 pages.
U.S. Appl. No. 29/528,890 for Mobile Computer Housing filed Jun. 2, 2015 (Fitch et al.); 61 pages;.
U.S. Appl. No. 29/526,918 for Charging Base filed May 14, 2015 (Fitch et al.); 10 pages.
U.S. Appl. No. 14/715,916 for Evaluating Image Values filed May 19, 2015 (Ackley); 60 pages.
U.S. Appl. No. 29/525,068 for Tablet Computer With Removable Scanning Device filed Apr. 27, 2015 (Schulte et al.); 19 pages.
U.S. Appl. No. 29/468,118 for an Electronic Device Case, filed Sep. 26, 2013 (Oberpriller et al.); 44 pages.
U.S. Appl. No. 29/530,600 for Cyclone filed Jun. 18, 2015 (Vargo et al); 16 pages.
U.S. Appl. No. 14/707,123 for Application Independent DEX/UCS Interface filed May 8, 2015 (Pape); 47 pages.
U.S. Appl. No. 14/283,282 for Terminal Having Illumination and Focus Control filed May 21, 2014 (Liu et al.); 31 pages; now abandoned.
U.S. Appl. No. 14/705,407 for Method and System to Protect Software-Based Network-Connected Devices From Advanced Persistent Threat filed May 6, 2015 (Hussey et al.); 42 pages.
U.S. Appl. No. 14/704,050 for Intermediate Linear Positioning filed May 5, 2015 (Charpentier et al.); 60 pages.
U.S. Appl. No. 14/705,012 for Hands-Free Human Machine Interface Responsive to a Driver of a Vehicle filed May 6, 2015 (Fitch et al.); 44 pages.
U.S. Appl. No. 14/715,672 for Augumented Reality Enabled Hazard Display filed May 19, 2015 (Venkatesha et al.); 35 pages.
U.S. Appl. No. 14/735,717 for Indicia-Reading Systems Having an Interface With a User's Nervous System filed Jun. 10, 2015 (Todeschini); 39 pages.
U.S. Appl. No. 14/702,110 for System and Method for Regulating Barcode Data Injection Into a Running Application on a Smart Device filed May 1, 2015 (Todeschini et al.); 38 pages.
U.S. Appl. No. 14/747,197 for Optical Pattern Projector filed Jun. 23, 2015 (Thuries et al.); 33 pages.
U.S. Appl. No. 14/702,979 for Tracking Battery Conditions filed May 4, 2015 (Young et al.); 70 pages.
U.S. Appl. No. 29/529,441 for Indicia Reading Device filed Jun. 8, 2015 (Zhou et al.); 14 pages.
U.S. Appl. No. 14/747,490 for Dual-Projector Three-Dimensional Scanner filed Jun. 23, 2015 (Jovanovski et al.); 40 pages.
U.S. Appl. No. 14/740,320 for Tactile Switch for a Mobile Electronic Device filed Jun. 16, 2015 (Barndringa); 38 pages.
U.S. Appl. No. 14/740,373 for Calibrating a Volume Dimensioner filed Jun. 16, 2015 (Ackley et al.); 63 pages.
U.S. Patent Application for a Laser Scanning Module Employing an Elastomeric U-Hinge Based Laser Scanning Assembly, filed Feb. 7, 2012 (Feng et al.), U.S. Appl. No. 13/367,978.
U.S. Patent Application for Indicia Reader filed Apr. 1, 2015 (Huck), U.S. Appl. No. 14/676,109.

* cited by examiner

RIGID YET FLEXIBLE SPINDLE FOR ROLLED MATERIAL

FIELD OF THE INVENTION

Embodiments of the present invention relate to a rigid yet flexible spindle for use with rolled materials (such as ribbon and labels) in a thermal printing device.

BACKGROUND

Thermal printing devices are well known in the art. One of the primary applications of thermal printing devices is label making, in which thermal ink is transferred onto a media, like a label, by sending data to the thermal print head and then powering/heating the elements of the thermal print head to transfer the desired pattern of thermal ink onto the label.

FIGS. 1A, 1B, and 1C illustrate a thermal printing system 100 as understood in the art. As shown in FIG. 1A, rolled materials (ribbon 101 and label 102) are unwound (ribbon unwind roll 103 and label unwind roll 104, respectively) and fed through the thermal print head 105 and the pressure roller 106. The elements of the thermal print head 105 are heated to transfer the desired pattern of thermal ink from the ribbon 101 to the label 102. The label 102 is then ejected from the thermal printing device (to be used for the purpose for which it was generated) and the used portion of ribbon 101 is wound up in the ribbon uptake roll 107. As shown in FIG. 1B, the ribbon unwind roll 103 has a ribbon core 108 which rotates around the ribbon unwind spindle 109 to allow the ribbon 101 to be fed into the thermal printing device. Similarly, as shown in FIG. 1C, the label unwind roll 104 has a label core 110 which rotates around the label unwind spindle 111 to allow the label 102 to be fed into the thermal printing device.

As FIGS. 1A, 1B, and 1C illustrate, much of the accuracy with thermal printing stems from the handling of rolled materials. Clearly, if the unwind spindles (109, 111) flex too much during the print job, the printing can warp and become unusable. Similarly, if the tolerance between the cores (108, 110) is too great, then it is possible for the rolled material to slip, which can also warp the printing and render the final product unusable.

Further, many thermal printing devices can be very small (such as barcode label makers, etc.) and have small spindles (such as a 0.5" diameter spindle). As such, there is not much room in the spindles for the rolled materials that would allow for complex mechanisms to prevent flexing of the spindle and slipping of the core around the spindle.

Accordingly, there is a need for a rigid yet flexible spindle for rolled material in a thermal printing device.

SUMMARY

Accordingly, one aspect of the present invention discloses a spindle comprising: a shaft comprised of a rigid component and a flexible component, wherein the rigid component is comprised of a plurality of ribs extending radially from the axis of the shaft and wherein the flexible component of the shaft is comprised of a plurality of flexible cantilevers.

In other embodiments, successive ones of the plurality of flexible cantilevers have alternating orientations.

In further embodiments, the ribs of the rigid component of the shaft are spaced at regular intervals along the length of the shaft.

In still further embodiments, the ribs of the rigid component of the shaft are spaced at irregular intervals along the length of the shaft.

In more embodiments, the shaft and the ribs of the rigid component of the shaft are made of the same material.

In separate embodiments, the rigid component and flexible component comprise different proportions of the shaft.

In still additional embodiments, the proportion of the rigid component is 50% and the proportion of the flexible component is 50%.

In additional embodiments, the spindle further comprises: a plurality of buttresses spaced along the axis of the shaft with the flexible cantilevers.

In expanded embodiments, the plurality of buttresses is spaced between adjacent ones of the plurality of flexible cantilevers.

In another embodiment, the plurality of buttresses is regularly spaced along the axis of the shaft.

In yet further embodiments, the shaft and plurality of buttresses are made of the same material.

In other embodiments, the plurality of flexible cantilevers is made of a material having appropriate tension and compression properties.

In further embodiments, the plurality of flexible cantilevers is a continuous part of a single flexible cantilever assembly.

In still further embodiments, each of the plurality of the flexible cantilevers have a beveled edge on both ends of the surface of the flexible cantilever that is in contact with a core of a rolled material.

In more embodiments, the diameter of the spindle is equal to or less than 0.5 inches.

In separate embodiments, the spindle further comprises: a plurality of hard stop features regularly spaced along the axis of the shaft, wherein each hard stop feature corresponds to the location of the free ends of each of the plurality of flexible cantilevers.

In still additional embodiments, the shaft and plurality of hard stop features are made of different materials.

In additional embodiments, each of the plurality of hard stop features sets a maximum possible displacement for each of the corresponding plurality of flexible cantilevers.

In expanded embodiments, each of the plurality of hard stop features prevents yielding of each of the corresponding plurality of flexible cantilevers.

The foregoing illustrative summary, as well as other exemplary objectives and/or advantages of the invention, and the manner in which the same are accomplished, are further explained within the following detailed description and its accompanying drawings.

DETAILED DESCRIPTION

Embodiments of the present invention describe a rigid yet flexible spindle. In some embodiments, the rigid yet flexible spindle is used with rolled material in a thermal printing device.

Figure 1A:
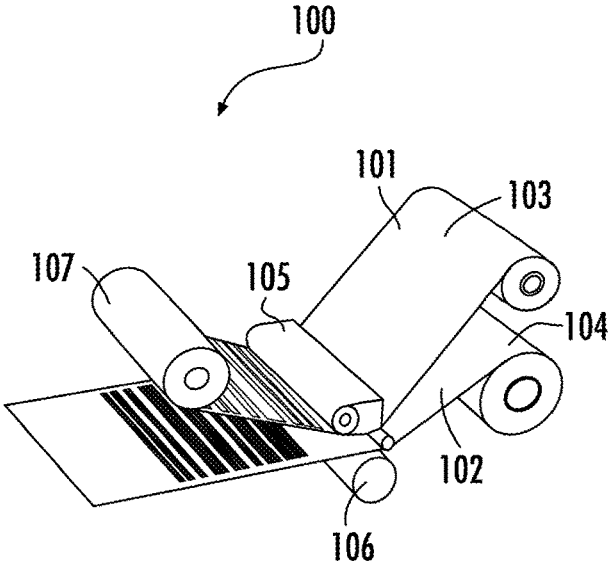
FIGS. 1A, 1B, and 1C are diagrams describing the basic mechanics of thermal printing devices as known in the art.
Figure 1B:
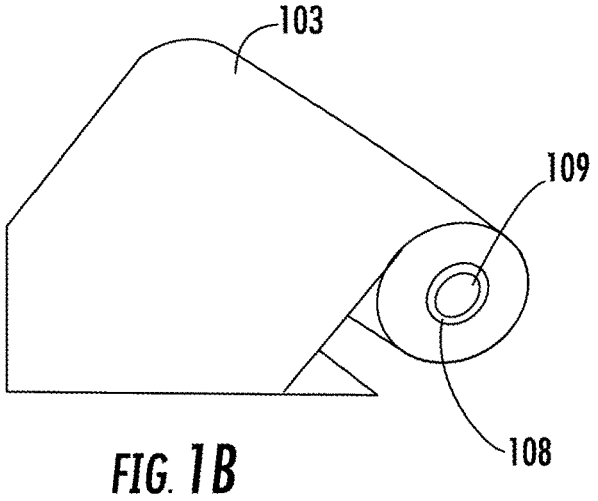
Figure 1C:
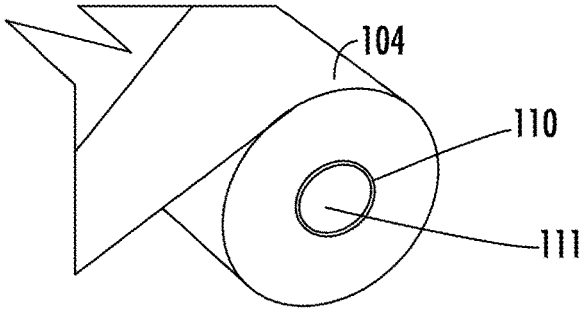
Figure 2A:
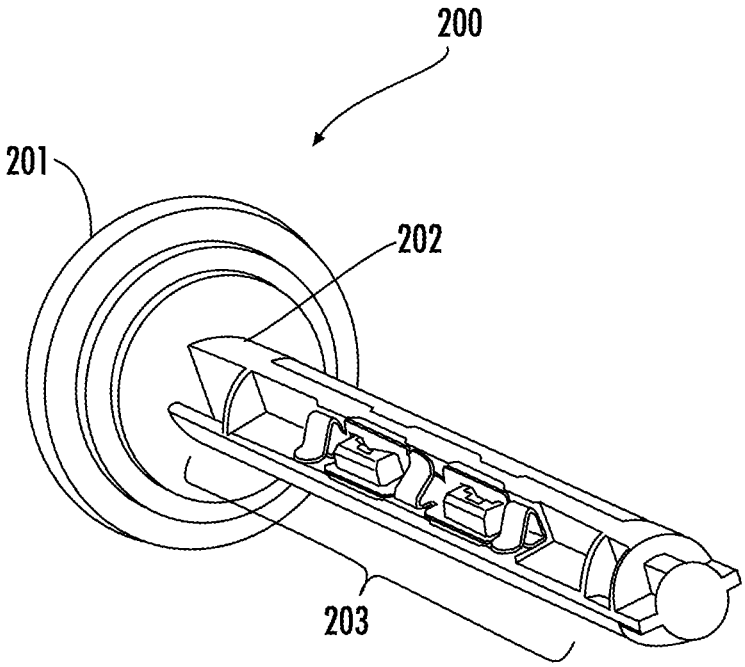
FIGS. 2A and 2B are diagrams of the rigid yet flexible spindle in accordance with embodiments of the present invention.
Figure 2B:
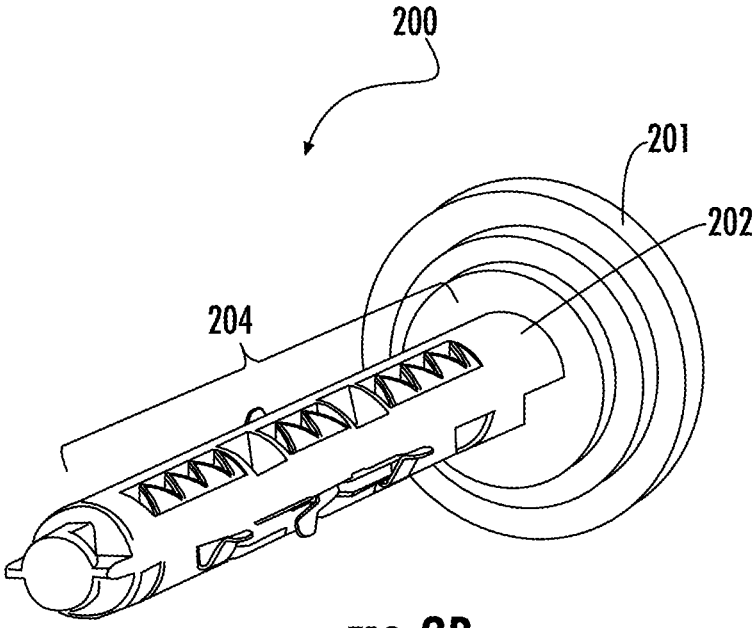

FIGS. 2A and 2B are diagrams of the rigid yet flexible spindle in accordance with embodiments of the present invention. FIG. 2A illustrates one view of the rigid yet flexible spindle 200. The rigid yet flexible spindle 200 has a shaft 202. In some embodiments, the rigid yet flexible spindle 200 may additionally have a base 201 which is orthogonally connected to the shaft 202. In some embodiments, the base 201 is comprised of a plurality of stacked concentric discs. The base 201 may take the form of any of a variety of connectors commonly used to connect the spindle 200 to a target device or machine, such as a thermal printing device. The end of the shaft 202 opposite the base 201 is free or floating (i.e. not secured or connected to a target device or machine) so as to allow the installation of a rolled material on the spindle, such as a ribbon or some other media. The rigid yet flexible spindle 200 may be made from any of a variety of materials. In most embodiments, the rigid yet flexible spindle 200 is made of a plastic material because plastic allows for the creation of complex features while maintaining a low cost of manufacture. In one embodiment shown in FIGS. 2A and 2B, the rigid yet flexible spindle 200 is made from a plastic polymer in an injection mold.

The unique feature of the rigid yet flexible spindle 200 is that one portion of the shaft 202 of the spindle 200 comprises a rigid component 204 and the other portion of the shaft 202 of the spindle 200 comprises a flexible component 203. As illustrated in FIGS. 2A and 2B, the rigid component 204 and flexible component 203 each comprises half of the spindle 200, however, in other embodiments, the components may represent different portions and/or percentages of the shaft as required for specific applications.

The flexible component 203 of the rigid yet flexible spindle 200 is designed to address core tolerance issues in the rolled media and to retain the core's relative movement. The rigid component 204 of the rigid yet flexible spindle 200 is designed to prevent the spindle from flexing during printing.

Figure 3A:
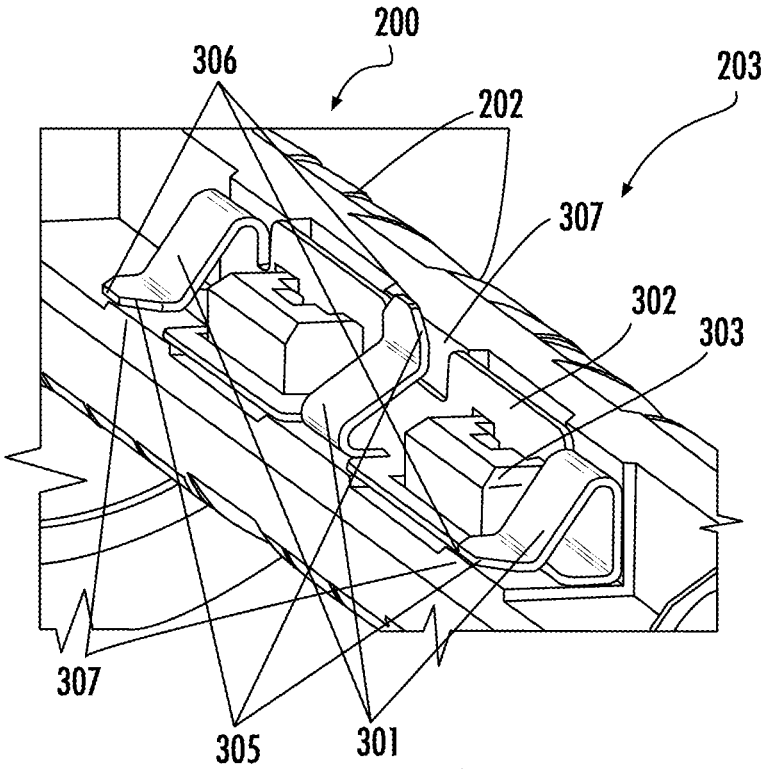
FIGS. 3A and 3B are diagrams offering a close up view of the elements of the flexible and rigid components of rigid yet flexible spindle in accordance with embodiments of the present invention.
Figure 3B:
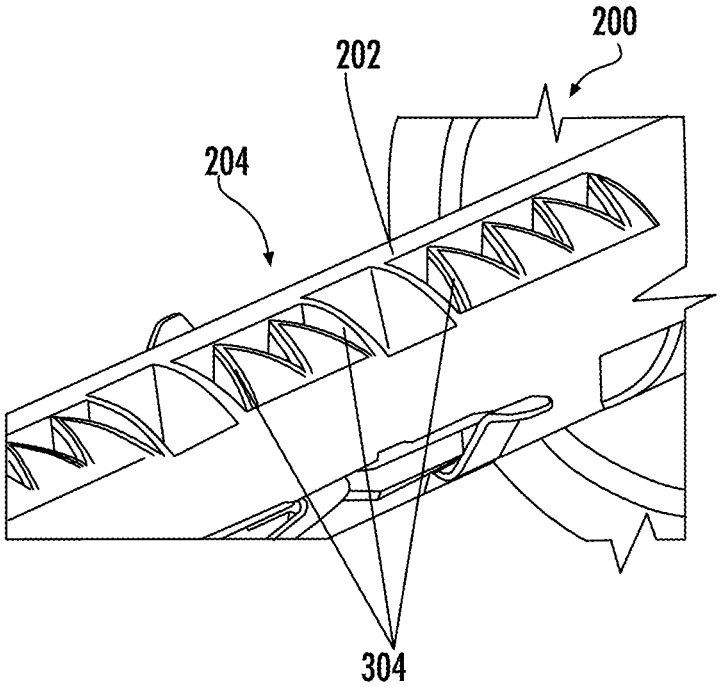

FIGS. 3A and 3B are diagrams offering a close up view of the elements of the flexible 203 and rigid 204 components of rigid yet flexible spindle in accordance with embodiments of the present invention.

In FIG. 3A, the flexible component 203 of the rigid yet flexible spindle 200 comprises a plurality of flexible cantilevers 301. In some embodiments, the flexible cantilevers 301 are regularly spaced along the axis of the shaft 202. In some embodiments, like the one shown in FIG. 3A, the orientation of adjacent flexible cantilevers 307 alternate along the axis of the shaft 202. In other words, as shown in FIG. 3A, the free end of the flexible cantilever 301 nearest the base 201 points to the left of the shaft 202 while the free end of the next flexible cantilever 301 points to the top of the shaft 202, with the pattern repeating until the end of the shaft 202 is reached.

In between the flexible cantilevers 301 are buttresses 303 that are designed to hold the flexible cantilevers in place in the spindle 200 and provide the reinforcement for the flexible cantilevers 301. In some embodiments, the buttresses 303 are made of the same material as the rest of the rigid yet flexible spindle 200 and are part of the same injection molding manufacturing process for the spindle 200.

The flexible cantilevers 301 may be made of any material that is capable of supporting compression and tension forces. In one embodiment, the flexible cantilevers are made of steel. In another embodiment, the flexible cantilevers may be contiguous as part of a single flexible cantilever assembly 302, as shown in FIG. 3A. The flexible cantilevers 301 further have a bevel 305 that is designed to allow the core (109, 111) to slip over the spindle but yet provide a flat edge 306 to grip into and provide resistance against the inside surface of the core (109, 111).

The rigid yet flexible spindle 200 further comprises a plurality of hard stop features 307 regularly spaced along the axis of the shaft 202 corresponding to the locations of the free ends of the flexible cantilevers 301. Note that as shown in FIG. 3A, the free ends of the flexible cantilevers 301 alternate along the axis of the shaft 202, and so the hard stop features 307 alternate in the same pattern. In some embodiments, the hard stop features 307 are made of the same material as the rest of the rigid yet flexible spindle 200 and are part of the same injection molding manufacturing process for the spindle 200. In other embodiments, the hard stop features 307 are made of a different material from the shaft 202 of the rigid yet flexible spindle 200. The hard stop features 307 prevent yielding of the flexible cantilevers 301 by setting a maximum possible displacement.

In FIG. 3B, the rigid component 204 of the rigid yet flexible spindle 200 comprises a plurality of ribs 304 extending radially from the axis of the shaft 202. In some embodiments, the ribs 304 are spaced at intervals along the axis of the shaft 202. In some embodiments, the ribs 304 are regularly spaced. In other embodiments, the ribs 304 are variable or irregularly spaced. In still further embodiments, the ribs 304 have a mixed pattern of regular and irregular spacing, as shown in FIG. 3B. In some embodiments, the ribs 304 are made from the same material as the rest of the spindle 200 as part of an injection molding process. In other embodiments, the ribs 304 may be made of a different material from the shaft 202 of the rigid yet flexible spindle 200.

Figure 4A:
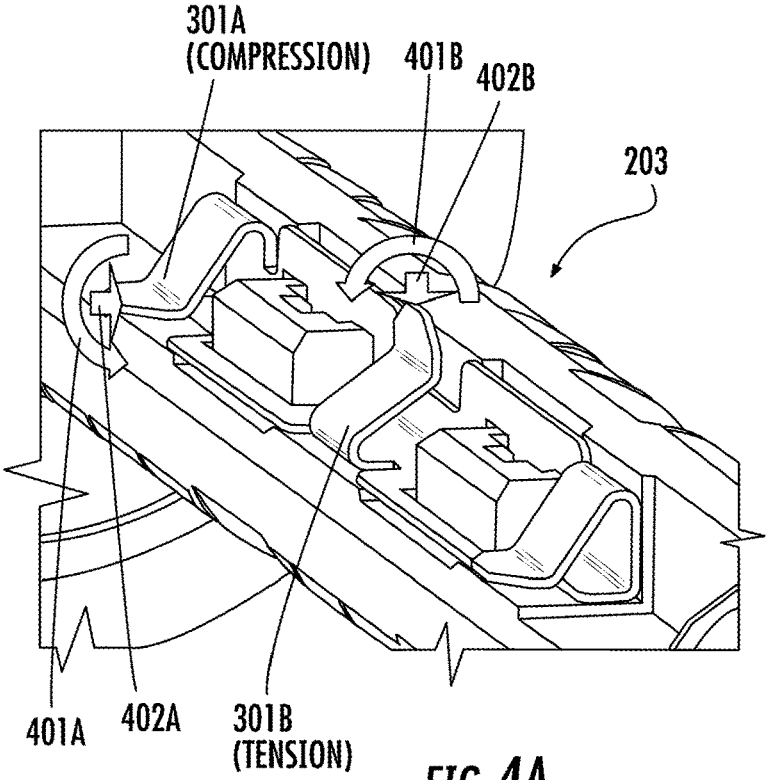
FIGS. 4A and 4B are diagrams illustrating forces on the flexible component of the rigid yet flexible spindle in accordance with embodiments of the present invention.
Figure 4B:
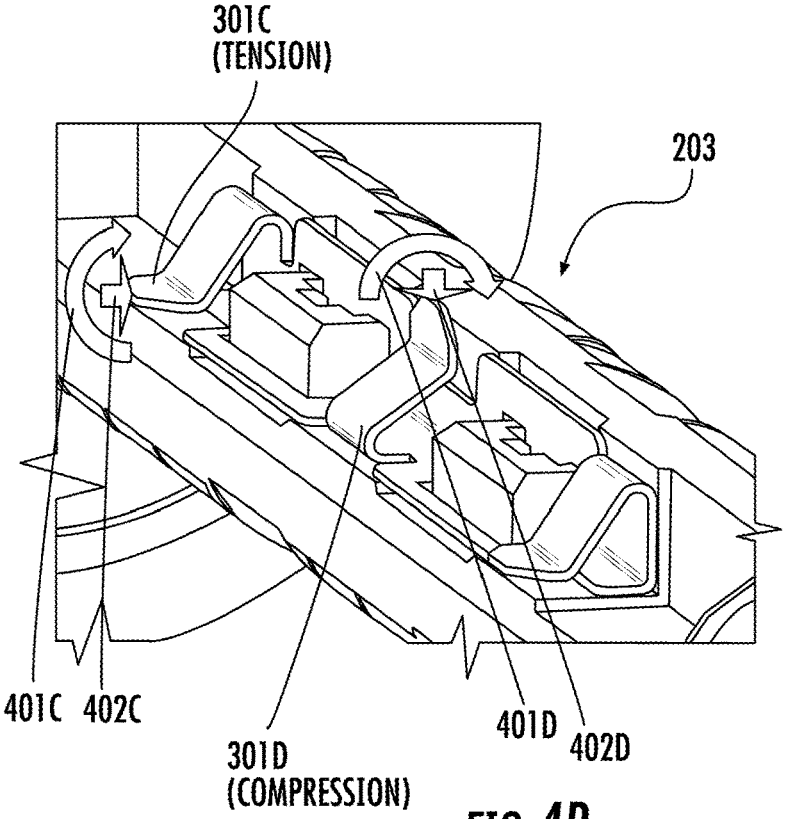

FIGS. 4A and 4B are diagrams illustrating forces on the flexible component 203 of the rigid yet flexible spindle 200 in accordance with embodiments of the present invention. In FIG. 4A, flexible cantilever 301A is experiencing compression forces both from the rotational force 401A of the core (109, 111) spinning around the spindle 200 but also from the core force 402A pressing on the flexible cantilever 301A from fitting onto the spindle 200. Further, in FIG. 4A, flexible cantilever 301B is experiencing a tension force from the rotational force 401B of the core (109, 111) spinning around the spindle 200 and a compression force from the core force 402B pressing on the flexible cantilever 301B from fitting onto the spindle 200.

The core forces 402A and 402B allow the spindle 200 to hold the core (109, 111) in place and adapt to small variations in core tolerance. The rotational forces (401A and 401B) in the same direction produce an opposite bending of the flexible cantilevers (301A and 301B), allowing them to bite into the core (109, 111) thereby retaining the relative movement between the core (109, 111) and the spindle 200.

FIG. 4B is similar to FIG. 4A but for a core spinning in the opposite direction. In FIG. 4B, flexible cantilever 301C is experiencing a tension force from the rotational force 401C of the core (109, 111) spinning around the spindle 200 and a compression force from the core force 402C pressing on the flexible cantilever 301C from fitting onto the spindle 200. Also, flexible cantilever 301D is experiencing compression forces both from the rotational force 401D of the core (109, 111) spinning around the spindle 200 but also from the core force 402D pressing on the flexible cantilever 301D from fitting onto the spindle 200.

Again, the core forces 402C and 402D allow the spindle 200 to hold the core (109, 111) in place and adapt to small variations in core tolerance. The rotational forces (401C and 401D) in the same direction produce an opposite bending of the flexible cantilevers (301C and 301D), allowing them to bite into the core (109, 111) thereby retaining the relative movement between the core (109, 111) and the spindle 200.

The hard stop features 307 of the rigid yet flexible spindle 200 set a maximum possible displacement for the flexible cantilevers 301 in response to the rotational forces 401A, 401B, 401C, and 401D and prevent the yielding of the flexible cantilevers 301 under the application of those rotational forces.

The disclosed subject matter may be embodied as devices, systems, methods.

To supplement the present disclosure, this application incorporates entirely by reference the following commonly assigned patents, patent application publications, and patent applications:

U.S. Pat. Nos. 6,832,725; 7,128,266;
U.S. Pat. Nos. 7,159,783; 7,413,127;
U.S. Pat. Nos. 7,726,575; 8,294,969;
U.S. Pat. Nos. 8,317,105; 8,322,622;
U.S. Pat. Nos. 8,366,005; 8,371,507;
U.S. Pat. Nos. 8,376,233; 8,381,979;
U.S. Pat. Nos. 8,390,909; 8,408,464;
U.S. Pat. Nos. 8,408,468; 8,408,469;
U.S. Pat. Nos. 8,424,768; 8,448,863;
U.S. Pat. Nos. 8,457,013; 8,459,557;
U.S. Pat. Nos. 8,469,272; 8,474,712;
U.S. Pat. Nos. 8,479,992; 8,490,877;
U.S. Pat. Nos. 8,517,271; 8,523,076;
U.S. Pat. Nos. 8,528,818; 8,544,737;
U.S. Pat. Nos. 8,548,242; 8,548,420;
U.S. Pat. Nos. 8,550,335; 8,550,354;
U.S. Pat. Nos. 8,550,357; 8,556,174;
U.S. Pat. Nos. 8,556,176; 8,556,177;
U.S. Pat. Nos. 8,559,767; 8,599,957;
U.S. Pat. Nos. 8,561,895; 8,561,903;
U.S. Pat. Nos. 8,561,905; 8,565,107;
U.S. Pat. Nos. 8,571,307; 8,579,200;
U.S. Pat. Nos. 8,583,924; 8,584,945;
U.S. Pat. Nos. 8,587,595; 8,587,697;
U.S. Pat. Nos. 8,588,869; 8,590,789;
U.S. Pat. Nos. 8,596,539; 8,596,542;
U.S. Pat. Nos. 8,596,543; 8,599,271;
U.S. Pat. Nos. 8,599,957; 8,600,158;
U.S. Pat. Nos. 8,600,167; 8,602,309;
U.S. Pat. Nos. 8,608,053; 8,608,071;
U.S. Pat. Nos. 8,611,309; 8,615,487;
U.S. Pat. Nos. 8,616,454; 8,621,123;
U.S. Pat. Nos. 8,622,303; 8,628,013;
U.S. Pat. Nos. 8,628,015; 8,628,016;
U.S. Pat. Nos. 8,629,926; 8,630,491;
U.S. Pat. Nos. 8,635,309; 8,636,200;
U.S. Pat. Nos. 8,636,212; 8,636,215;
U.S. Pat. Nos. 8,636,224; 8,638,806;
U.S. Pat. Nos. 8,640,958; 8,640,960;
U.S. Pat. Nos. 8,643,717; 8,646,692;
U.S. Pat. Nos. 8,646,694; 8,657,200;
U.S. Pat. Nos. 8,659,397; 8,668,149;
U.S. Pat. Nos. 8,678,285; 8,678,286;
U.S. Pat. Nos. 8,682,077; 8,687,282;
U.S. Pat. Nos. 8,692,927; 8,695,880;
U.S. Pat. Nos. 8,698,949; 8,717,494;
U.S. Pat. Nos. 8,717,494; 8,720,783;
U.S. Pat. Nos. 8,723,804; 8,723,904;
U.S. Pat. No. 8,727,223; U.S. Pat. No. D702,237;
U.S. Pat. Nos. 8,740,082; 8,740,085;
U.S. Pat. Nos. 8,746,563; 8,750,445;
U.S. Pat. Nos. 8,752,766; 8,756,059;
U.S. Pat. Nos. 8,757,495; 8,760,563;
U.S. Pat. Nos. 8,763,909; 8,777,108;
U.S. Pat. Nos. 8,777,109; 8,779,898;
U.S. Pat. Nos. 8,781,520; 8,783,573;
U.S. Pat. Nos. 8,789,757; 8,789,758;
U.S. Pat. Nos. 8,789,759; 8,794,520;
U.S. Pat. Nos. 8,794,522; 8,794,525;
U.S. Pat. Nos. 8,794,526; 8,798,367;
U.S. Pat. Nos. 8,807,431; 8,807,432;
U.S. Pat. Nos. 8,820,630; 8,822,848;
U.S. Pat. Nos. 8,824,692; 8,824,696;
U.S. Pat. Nos. 8,842,849; 8,844,822;
U.S. Pat. Nos. 8,844,823; 8,849,019;
U.S. Pat. Nos. 8,851,383; 8,854,633;
U.S. Pat. Nos. 8,866,963; 8,868,421;
U.S. Pat. Nos. 8,868,519; 8,868,802;
U.S. Pat. Nos. 8,868,803; 8,870,074;
U.S. Pat. Nos. 8,879,639; 8,880,426;
U.S. Pat. Nos. 8,881,983; 8,881,987;
U.S. Pat. Nos. 8,903,172; 8,908,995;
U.S. Pat. Nos. 8,910,870; 8,910,875;
U.S. Pat. Nos. 8,914,290; 8,914,788;
U.S. Pat. Nos. 8,915,439; 8,915,444;
U.S. Pat. Nos. 8,916,789; 8,918,250;
U.S. Pat. Nos. 8,918,564; 8,925,818;
U.S. Pat. Nos. 8,939,374; 8,942,480;
U.S. Pat. Nos. 8,944,313; 8,944,327;
U.S. Pat. Nos. 8,944,332; 8,950,678;
U.S. Pat. Nos. 8,967,468; 8,971,346;
U.S. Pat. Nos. 8,976,030; 8,976,368;
U.S. Pat. Nos. 8,978,981; 8,978,983;
U.S. Pat. Nos. 8,978,984; 8,985,456;
U.S. Pat. Nos. 8,985,457; 8,985,459;
U.S. Pat. Nos. 8,985,461; 8,988,578;
U.S. Pat. Nos. 8,988,590; 8,991,704;
U.S. Pat. Nos. 8,996,194; 8,996,384;
U.S. Pat. Nos. 9,002,641; 9,007,368;
U.S. Pat. Nos. 9,010,641; 9,015,513;
U.S. Pat. Nos. 9,016,576; 9,022,288;
U.S. Pat. Nos. 9,030,964; 9,033,240;
U.S. Pat. Nos. 9,033,242; 9,036,054;
U.S. Pat. Nos. 9,037,344; 9,038,911;
U.S. Pat. Nos. 9,038,915; 9,047,098;
U.S. Pat. Nos. 9,047,359; 9,047,420;
U.S. Pat. Nos. 9,047,525; 9,047,531;
U.S. Pat. Nos. 9,053,055; 9,053,378;
U.S. Pat. Nos. 9,053,380; 9,058,526;
U.S. Pat. Nos. 9,064,165; 9,064,167;
U.S. Pat. Nos. 9,064,168; 9,064,254;
U.S. Pat. Nos. 9,066,032; 9,070,032;
U.S. Design Pat. No. D716,285;
U.S. Design Pat. No. D723,560;
U.S. Design Pat. No. D730,357;
U.S. Design Pat. No. D730,901;
U.S. Design Pat. No. D730,902;
U.S. Design Pat. No. D733,112;
U.S. Design Pat. No. D734,339;
International Publication No. 2013/163789;
International Publication No. 2013/173985;
International Publication No. 2014/019130;

International Publication No. 2014/110495;
U.S. Patent Application Publication No. 2008/0185432;
U.S. Patent Application Publication No. 2009/0134221;
U.S. Patent Application Publication No. 2010/0177080;
U.S. Patent Application Publication No. 2010/0177076;
U.S. Patent Application Publication No. 2010/0177707;
U.S. Patent Application Publication No. 2010/0177749;
U.S. Patent Application Publication No. 2010/0265880;
U.S. Patent Application Publication No. 2011/0202554;
U.S. Patent Application Publication No. 2012/0111946;
U.S. Patent Application Publication No. 2012/0168511;
U.S. Patent Application Publication No. 2012/0168512;
U.S. Patent Application Publication No. 2012/0193423;
U.S. Patent Application Publication No. 2012/0203647;
U.S. Patent Application Publication No. 2012/0223141;
U.S. Patent Application Publication No. 2012/0228382;
U.S. Patent Application Publication No. 2012/0248188;
U.S. Patent Application Publication No. 2013/0043312;
U.S. Patent Application Publication No. 2013/0082104;
U.S. Patent Application Publication No. 2013/0175341;
U.S. Patent Application Publication No. 2013/0175343;
U.S. Patent Application Publication No. 2013/0257744;
U.S. Patent Application Publication No. 2013/0257759;
U.S. Patent Application Publication No. 2013/0270346;
U.S. Patent Application Publication No. 2013/0287258;
U.S. Patent Application Publication No. 2013/0292475;
U.S. Patent Application Publication No. 2013/0292477;
U.S. Patent Application Publication No. 2013/0293539;
U.S. Patent Application Publication No. 2013/0293540;
U.S. Patent Application Publication No. 2013/0306728;
U.S. Patent Application Publication No. 2013/0306731;
U.S. Patent Application Publication No. 2013/0307964;
U.S. Patent Application Publication No. 2013/0308625;
U.S. Patent Application Publication No. 2013/0313324;
U.S. Patent Application Publication No. 2013/0313325;
U.S. Patent Application Publication No. 2013/0342717;
U.S. Patent Application Publication No. 2014/0001267;
U.S. Patent Application Publication No. 2014/0008439;
U.S. Patent Application Publication No. 2014/0025584;
U.S. Patent Application Publication No. 2014/0034734;
U.S. Patent Application Publication No. 2014/0036848;
U.S. Patent Application Publication No. 2014/0039693;
U.S. Patent Application Publication No. 2014/0042814;
U.S. Patent Application Publication No. 2014/0049120;
U.S. Patent Application Publication No. 2014/0049635;
U.S. Patent Application Publication No. 2014/0061306;
U.S. Patent Application Publication No. 2014/0063289;
U.S. Patent Application Publication No. 2014/0066136;
U.S. Patent Application Publication No. 2014/0067692;
U.S. Patent Application Publication No. 2014/0070005;
U.S. Patent Application Publication No. 2014/0071840;
U.S. Patent Application Publication No. 2014/0074746;
U.S. Patent Application Publication No. 2014/0076974;
U.S. Patent Application Publication No. 2014/0078341;
U.S. Patent Application Publication No. 2014/0078345;
U.S. Patent Application Publication No. 2014/0097249;
U.S. Patent Application Publication No. 2014/0098792;
U.S. Patent Application Publication No. 2014/0100813;
U.S. Patent Application Publication No. 2014/0103115;
U.S. Patent Application Publication No. 2014/0104413;
U.S. Patent Application Publication No. 2014/0104414;
U.S. Patent Application Publication No. 2014/0104416;
U.S. Patent Application Publication No. 2014/0104451;
U.S. Patent Application Publication No. 2014/0106594;
U.S. Patent Application Publication No. 2014/0106725;
U.S. Patent Application Publication No. 2014/0108010;
U.S. Patent Application Publication No. 2014/0108402;
U.S. Patent Application Publication No. 2014/0110485;
U.S. Patent Application Publication No. 2014/0114530;
U.S. Patent Application Publication No. 2014/0124577;
U.S. Patent Application Publication No. 2014/0124579;
U.S. Patent Application Publication No. 2014/0125842;
U.S. Patent Application Publication No. 2014/0125853;
U.S. Patent Application Publication No. 2014/0125999;
U.S. Patent Application Publication No. 2014/0129378;
U.S. Patent Application Publication No. 2014/0131438;
U.S. Patent Application Publication No. 2014/0131441;
U.S. Patent Application Publication No. 2014/0131443;
U.S. Patent Application Publication No. 2014/0131444;
U.S. Patent Application Publication No. 2014/0131445;
U.S. Patent Application Publication No. 2014/0131448;
U.S. Patent Application Publication No. 2014/0133379;
U.S. Patent Application Publication No. 2014/0136208;
U.S. Patent Application Publication No. 2014/0140585;
U.S. Patent Application Publication No. 2014/0151453;
U.S. Patent Application Publication No. 2014/0152882;
U.S. Patent Application Publication No. 2014/0158770;
U.S. Patent Application Publication No. 2014/0159869;
U.S. Patent Application Publication No. 2014/0166755;
U.S. Patent Application Publication No. 2014/0166759;
U.S. Patent Application Publication No. 2014/0168787;
U.S. Patent Application Publication No. 2014/0175165;
U.S. Patent Application Publication No. 2014/0175172;
U.S. Patent Application Publication No. 2014/0191644;
U.S. Patent Application Publication No. 2014/0191913;
U.S. Patent Application Publication No. 2014/0197238;
U.S. Patent Application Publication No. 2014/0197239;
U.S. Patent Application Publication No. 2014/0197304;
U.S. Patent Application Publication No. 2014/0214631;
U.S. Patent Application Publication No. 2014/0217166;
U.S. Patent Application Publication No. 2014/0217180;
U.S. Patent Application Publication No. 2014/0231500;
U.S. Patent Application Publication No. 2014/0232930;
U.S. Patent Application Publication No. 2014/0247315;
U.S. Patent Application Publication No. 2014/0263493;
U.S. Patent Application Publication No. 2014/0263645;
U.S. Patent Application Publication No. 2014/0267609;
U.S. Patent Application Publication No. 2014/0270196;
U.S. Patent Application Publication No. 2014/0270229;
U.S. Patent Application Publication No. 2014/0278387;
U.S. Patent Application Publication No. 2014/0278391;
U.S. Patent Application Publication No. 2014/0282210;
U.S. Patent Application Publication No. 2014/0284384;
U.S. Patent Application Publication No. 2014/0288933;
U.S. Patent Application Publication No. 2014/0297058;
U.S. Patent Application Publication No. 2014/0299665;
U.S. Patent Application Publication No. 2014/0312121;
U.S. Patent Application Publication No. 2014/0319220;
U.S. Patent Application Publication No. 2014/0319221;
U.S. Patent Application Publication No. 2014/0326787;
U.S. Patent Application Publication No. 2014/0332590;
U.S. Patent Application Publication No. 2014/0344943;
U.S. Patent Application Publication No. 2014/0346233;
U.S. Patent Application Publication No. 2014/0351317;
U.S. Patent Application Publication No. 2014/0353373;
U.S. Patent Application Publication No. 2014/0361073;
U.S. Patent Application Publication No. 2014/0361082;
U.S. Patent Application Publication No. 2014/0362184;
U.S. Patent Application Publication No. 2014/0363015;
U.S. Patent Application Publication No. 2014/0369511;
U.S. Patent Application Publication No. 2014/0374483;
U.S. Patent Application Publication No. 2014/0374485;
U.S. Patent Application Publication No. 2015/0001301;
U.S. Patent Application Publication No. 2015/0001304;

U.S. Patent Application Publication No. 2015/0003673;
U.S. Patent Application Publication No. 2015/0009338;
U.S. Patent Application Publication No. 2015/0009610;
U.S. Patent Application Publication No. 2015/0014416;
U.S. Patent Application Publication No. 2015/0021397;
U.S. Patent Application Publication No. 2015/0028102;
U.S. Patent Application Publication No. 2015/0028103;
U.S. Patent Application Publication No. 2015/0028104;
U.S. Patent Application Publication No. 2015/0029002;
U.S. Patent Application Publication No. 2015/0032709;
U.S. Patent Application Publication No. 2015/0039309;
U.S. Patent Application Publication No. 2015/0039878;
U.S. Patent Application Publication No. 2015/0040378;
U.S. Patent Application Publication No. 2015/0048168;
U.S. Patent Application Publication No. 2015/0049347;
U.S. Patent Application Publication No. 2015/0051992;
U.S. Patent Application Publication No. 2015/0053766;
U.S. Patent Application Publication No. 2015/0053768;
U.S. Patent Application Publication No. 2015/0053769;
U.S. Patent Application Publication No. 2015/0060544;
U.S. Patent Application Publication No. 2015/0062366;
U.S. Patent Application Publication No. 2015/0063215;
U.S. Patent Application Publication No. 2015/0063676;
U.S. Patent Application Publication No. 2015/0069130;
U.S. Patent Application Publication No. 2015/0071819;
U.S. Patent Application Publication No. 2015/0083800;
U.S. Patent Application Publication No. 2015/0086114;
U.S. Patent Application Publication No. 2015/0088522;
U.S. Patent Application Publication No. 2015/0096872;
U.S. Patent Application Publication No. 2015/0099557;
U.S. Patent Application Publication No. 2015/0100196;
U.S. Patent Application Publication No. 2015/0102109;
U.S. Patent Application Publication No. 2015/0115035;
U.S. Patent Application Publication No. 2015/0127791;
U.S. Patent Application Publication No. 2015/0128116;
U.S. Patent Application Publication No. 2015/0129659;
U.S. Patent Application Publication No. 2015/0133047;
U.S. Patent Application Publication No. 2015/0134470;
U.S. Patent Application Publication No. 2015/0136851;
U.S. Patent Application Publication No. 2015/0136854;
U.S. Patent Application Publication No. 2015/0142492;
U.S. Patent Application Publication No. 2015/0144692;
U.S. Patent Application Publication No. 2015/0144698;
U.S. Patent Application Publication No. 2015/0144701;
U.S. Patent Application Publication No. 2015/0149946;
U.S. Patent Application Publication No. 2015/0161429;
U.S. Patent Application Publication No. 2015/0169925;
U.S. Patent Application Publication No. 2015/0169929;
U.S. Patent Application Publication No. 2015/0178523;
U.S. Patent Application Publication No. 2015/0178534;
U.S. Patent Application Publication No. 2015/0178535;
U.S. Patent Application Publication No. 2015/0178536;
U.S. Patent Application Publication No. 2015/0178537;
U.S. Patent Application Publication No. 2015/0181093;
U.S. Patent Application Publication No. 2015/0181109;

U.S. patent application Ser. No. 13/367,978 for a Laser Scanning Module Employing an Elastomeric U-Hinge Based Laser Scanning Assembly, filed Feb. 7, 2012 (Feng et al.);

U.S. patent application Ser. No. 29/458,405 for an Electronic Device, filed Jun. 19, 2013 (Fitch et al.);

U.S. patent application Ser. No. 29/459,620 for an Electronic Device Enclosure, filed Jul. 2, 2013 (London et al.);

U.S. patent application Ser. No. 29/468,118 for an Electronic Device Case, filed Sep. 26, 2013 (Oberpriller et al.);

U.S. patent application Ser. No. 14/150,393 for Indicia-reader Having Unitary Construction Scanner, filed Jan. 8, 2014 (Colavito et al.);

U.S. patent application Ser. No. 14/200,405 for Indicia Reader for Size-Limited Applications filed Mar. 7, 2014 (Feng et al.);

U.S. patent application Ser. No. 14/231,898 for Hand-Mounted Indicia-Reading Device with Finger Motion Triggering filed Apr. 1, 2014 (Van Horn et al.);

U.S. patent application Ser. No. 29/486,759 for an Imaging Terminal, filed Apr. 2, 2014 (Oberpriller et al.);

U.S. patent application Ser. No. 14/257,364 for Docking System and Method Using Near Field Communication filed Apr. 21, 2014 (Showering);

U.S. patent application Ser. No. 14/264,173 for Autofocus Lens System for Indicia Readers filed Apr. 29, 2014 (Ackley et al.);

U.S. patent application Ser. No. 14/277,337 for MULTI-PURPOSE OPTICAL READER, filed May 14, 2014 (Jovanovski et al.);

U.S. patent application Ser. No. 14/283,282 for TERMINAL HAVING ILLUMINATION AND FOCUS CONTROL filed May 21, 2014 (Liu et al.);

U.S. patent application Ser. No. 14/327,827 for a MOBILE-PHONE ADAPTER FOR ELECTRONIC TRANSACTIONS, filed Jul. 10, 2014 (Hejl);

U.S. patent application Ser. No. 14/334,934 for a SYSTEM AND METHOD FOR INDICIA VERIFICATION, filed Jul. 18, 2014 (Hejl);

U.S. patent application Ser. No. 14/339,708 for LASER SCANNING CODE SYMBOL READING SYSTEM, filed Jul. 24, 2014 (Xian et al.);

U.S. patent application Ser. No. 14/340,627 for an AXIALLY REINFORCED FLEXIBLE SCAN ELEMENT, filed Jul. 25, 2014 (Rueblinger et al.);

U.S. patent application Ser. No. 14/446,391 for MULTI-FUNCTION POINT OF SALE APPARATUS WITH OPTICAL SIGNATURE CAPTURE filed Jul. 30, 2014 (Good et al.);

U.S. patent application Ser. No. 14/452,697 for INTERACTIVE INDICIA READER, filed Aug. 6, 2014 (Todeschini);

U.S. patent application Ser. No. 14/453,019 for DIMENSIONING SYSTEM WITH GUIDED ALIGNMENT, filed Aug. 6, 2014 (Li et al.);

U.S. patent application Ser. No. 14/462,801 for MOBILE COMPUTING DEVICE WITH DATA COGNITION SOFTWARE, filed on Aug. 19, 2014 (Todeschini et al.);

U.S. patent application Ser. No. 14/483,056 for VARIABLE DEPTH OF FIELD BARCODE SCANNER filed Sep. 10, 2014 (McCloskey et al.);

U.S. patent application Ser. No. 14/513,808 for IDENTIFYING INVENTORY ITEMS IN A STORAGE FACILITY filed Oct. 14, 2014 (Singel et al.);

U.S. patent application Ser. No. 14/519,195 for HAND-HELD DIMENSIONING SYSTEM WITH FEEDBACK filed Oct. 21, 2014 (Laffargue et al.);

U.S. patent application Ser. No. 14/519,179 for DIMENSIONING SYSTEM WITH MULTIPATH INTERFERENCE MITIGATION filed Oct. 21, 2014 (Thuries et al.);

U.S. patent application Ser. No. 14/519,211 for SYSTEM AND METHOD FOR DIMENSIONING filed Oct. 21, 2014 (Ackley et al.);

U.S. patent application Ser. No. 14/519,233 for HAND-HELD DIMENSIONER WITH DATA-QUALITY INDICATION filed Oct. 21, 2014 (Laffargue et al.);

U.S. patent application Ser. No. 14/519,249 for HAND-HELD DIMENSIONING SYSTEM WITH MEASUREMENT-CONFORMANCE FEEDBACK filed Oct. 21, 2014 (Ackley et al.);

U.S. patent application Ser. No. 14/527,191 for METHOD AND SYSTEM FOR RECOGNIZING SPEECH USING WILDCARDS IN AN EXPECTED RESPONSE filed Oct. 29, 2014 (Braho et al.);

U.S. patent application Ser. No. 14/529,563 for ADAPTABLE INTERFACE FOR A MOBILE COMPUTING DEVICE filed Oct. 31, 2014 (Schoon et al.);

U.S. patent application Ser. No. 14/529,857 for BARCODE READER WITH SECURITY FEATURES filed Oct. 31, 2014 (Todeschini et al.);

U.S. patent application Ser. No. 14/398,542 for PORTABLE ELECTRONIC DEVICES HAVING A SEPARATE LOCATION TRIGGER UNIT FOR USE IN CONTROLLING AN APPLICATION UNIT filed Nov. 3, 2014 (Bian et al.);

U.S. patent application Ser. No. 14/531,154 for DIRECTING AN INSPECTOR THROUGH AN INSPECTION filed Nov. 3, 2014 (Miller et al.);

U.S. patent application Ser. No. 14/533,319 for BARCODE SCANNING SYSTEM USING WEARABLE DEVICE WITH EMBEDDED CAMERA filed Nov. 5, 2014 (Todeschini);

U.S. patent application Ser. No. 14/535,764 for CONCATENATED EXPECTED RESPONSES FOR SPEECH RECOGNITION filed Nov. 7, 2014 (Braho et al.);

U.S. patent application Ser. No. 14/568,305 for AUTO-CONTRAST VIEWFINDER FOR AN INDICIA READER filed Dec. 12, 2014 (Todeschini);

U.S. patent application Ser. No. 14/573,022 for DYNAMIC DIAGNOSTIC INDICATOR GENERATION filed Dec. 17, 2014 (Goldsmith);

U.S. patent application Ser. No. 14/578,627 for SAFETY SYSTEM AND METHOD filed Dec. 22, 2014 (Ackley et al.);

U.S. patent application Ser. No. 14/580,262 for MEDIA GATE FOR THERMAL TRANSFER PRINTERS filed Dec. 23, 2014 (Bowles);

U.S. patent application Ser. No. 14/590,024 for SHELVING AND PACKAGE LOCATING SYSTEMS FOR DELIVERY VEHICLES filed Jan. 6, 2015 (Payne);

U.S. patent application Ser. No. 14/596,757 for SYSTEM AND METHOD FOR DETECTING BARCODE PRINTING ERRORS filed Jan. 14, 2015 (Ackley);

U.S. patent application Ser. No. 14/416,147 for OPTICAL READING APPARATUS HAVING VARIABLE SETTINGS filed Jan. 21, 2015 (Chen et al.);

U.S. patent application Ser. No. 14/614,706 for DEVICE FOR SUPPORTING AN ELECTRONIC TOOL ON A USER'S HAND filed Feb. 5, 2015 (Oberpriller et al.);

U.S. patent application Ser. No. 14/614,796 for CARGO APPORTIONMENT TECHNIQUES filed Feb. 5, 2015 (Morton et al.);

U.S. patent application Ser. No. 29/516,892 for TABLE COMPUTER filed Feb. 6, 2015 (Bidwell et al.);

U.S. patent application Ser. No. 14/619,093 for METHODS FOR TRAINING A SPEECH RECOGNITION SYSTEM filed Feb. 11, 2015 (Pecorari);

U.S. patent application Ser. No. 14/628,708 for DEVICE, SYSTEM, AND METHOD FOR DETERMINING THE STATUS OF CHECKOUT LANES filed Feb. 23, 2015 (Todeschini);

U.S. patent application Ser. No. 14/630,841 for TERMINAL INCLUDING IMAGING ASSEMBLY filed Feb. 25, 2015 (Gomez et al.);

U.S. patent application Ser. No. 14/635,346 for SYSTEM AND METHOD FOR RELIABLE STORE-AND-FORWARD DATA HANDLING BY ENCODED INFORMATION READING TERMINALS filed Mar. 2, 2015 (Sevier);

U.S. patent application Ser. No. 29/519,017 for SCANNER filed Mar. 2, 2015 (Zhou et al.);

U.S. patent application Ser. No. 14/405,278 for DESIGN PATTERN FOR SECURE STORE filed Mar. 9, 2015 (Zhu et al.);

U.S. patent application Ser. No. 14/660,970 for DECODABLE INDICIA READING TERMINAL WITH COMBINED ILLUMINATION filed Mar. 18, 2015 (Kearney et al.);

U.S. patent application Ser. No. 14/661,013 for REPROGRAMMING SYSTEM AND METHOD FOR DEVICES INCLUDING PROGRAMMING SYMBOL filed Mar. 18, 2015 (Soule et al.);

U.S. patent application Ser. No. 14/662,922 for MULTI-FUNCTION POINT OF SALE SYSTEM filed Mar. 19, 2015 (Van Horn et al.);

U.S. patent application Ser. No. 14/663,638 for VEHICLE MOUNT COMPUTER WITH CONFIGURABLE IGNITION SWITCH BEHAVIOR filed Mar. 20, 2015 (Davis et al.);

U.S. patent application Ser. No. 14/664,063 for METHOD AND APPLICATION FOR SCANNING A BARCODE WITH A SMART DEVICE WHILE CONTINUOUSLY RUNNING AND DISPLAYING AN APPLICATION ON THE SMART DEVICE DISPLAY filed Mar. 20, 2015 (Todeschini);

U.S. patent application Ser. No. 14/669,280 for TRANSFORMING COMPONENTS OF A WEB PAGE TO VOICE PROMPTS filed Mar. 26, 2015 (Funyak et al.);

U.S. patent application Ser. No. 14/674,329 for AIMER FOR BARCODE SCANNING filed Mar. 31, 2015 (Bidwell);

U.S. patent application Ser. No. 14/676,109 for INDICIA READER filed Apr. 1, 2015 (Huck);

U.S. patent application Ser. No. 14/676,327 for DEVICE MANAGEMENT PROXY FOR SECURE DEVICES filed Apr. 1, 2015 (Yeakley et al.);

U.S. patent application Ser. No. 14/676,898 for NAVIGATION SYSTEM CONFIGURED TO INTEGRATE MOTION SENSING DEVICE INPUTS filed Apr. 2, 2015 (Showering);

U.S. patent application Ser. No. 14/679,275 for DIMENSIONING SYSTEM CALIBRATION SYSTEMS AND METHODS filed Apr. 6, 2015 (Laffargue et al.);

U.S. patent application Ser. No. 29/523,098 for HANDLE FOR A TABLET COMPUTER filed Apr. 7, 2015 (Bidwell et al.);

U.S. patent application Ser. No. 14/682,615 for SYSTEM AND METHOD FOR POWER MANAGEMENT OF MOBILE DEVICES filed Apr. 9, 2015 (Murawski et al.);

U.S. patent application Ser. No. 14/686,822 for MULTIPLE PLATFORM SUPPORT SYSTEM AND METHOD filed Apr. 15, 2015 (Qu et al.);

U.S. patent application Ser. No. 14/687,289 for SYSTEM FOR COMMUNICATION VIA A PERIPHERAL HUB filed Apr. 15, 2015 (Kohtz et al.);

U.S. patent application Ser. No. 29/524,186 for SCANNER filed Apr. 17, 2015 (Zhou et al.);

U.S. patent application Ser. No. 14/695,364 for MEDICATION MANAGEMENT SYSTEM filed Apr. 24, 2015 (Sewell et al.);

U.S. patent application Ser. No. 14/695,923 for SECURE UNATTENDED NETWORK AUTHENTICATION filed Apr. 24, 2015 (Kubler et al.);

U.S. patent application Ser. No. 29/525,068 for TABLET COMPUTER WITH REMOVABLE SCANNING DEVICE filed Apr. 27, 2015 (Schulte et al.);

U.S. patent application Ser. No. 14/699,436 for SYMBOL READING SYSTEM HAVING PREDICTIVE DIAGNOSTICS filed Apr. 29, 2015 (Nahill et al.);

U.S. patent application Ser. No. 14/702,110 for SYSTEM AND METHOD FOR REGULATING BARCODE DATA INJECTION INTO A RUNNING APPLICATION ON A SMART DEVICE filed May 1, 2015 (Todeschini et al.);

U.S. patent application Ser. No. 14/702,979 for TRACKING BATTERY CONDITIONS filed May 4, 2015 (Young et al.);

U.S. patent application Ser. No. 14/704,050 for INTERMEDIATE LINEAR POSITIONING filed May 5, 2015 (Charpentier et al.);

U.S. patent application Ser. No. 14/705,012 for HANDS-FREE HUMAN MACHINE INTERFACE RESPONSIVE TO A DRIVER OF A VEHICLE filed May 6, 2015 (Fitch et al.);

U.S. patent application Ser. No. 14/705,407 for METHOD AND SYSTEM TO PROTECT SOFTWARE-BASED NETWORK-CONNECTED DEVICES FROM ADVANCED PERSISTENT THREAT filed May 6, 2015 (Hussey et al.);

U.S. patent application Ser. No. 14/707,037 for SYSTEM AND METHOD FOR DISPLAY OF INFORMATION USING A VEHICLE-MOUNT COMPUTER filed May 8, 2015 (Chamberlin);

U.S. patent application Ser. No. 14/707,123 for APPLICATION INDEPENDENT DEX/UCS INTERFACE filed May 8, 2015 (Pape);

U.S. patent application Ser. No. 14/707,492 for METHOD AND APPARATUS FOR READING OPTICAL INDICIA USING A PLURALITY OF DATA SOURCES filed May 8, 2015 (Smith et al.);

U.S. patent application Ser. No. 14/710,666 for PRE-PAID USAGE SYSTEM FOR ENCODED INFORMATION READING TERMINALS filed May 13, 2015 (Smith);

U.S. patent application Ser. No. 29/526,918 for CHARGING BASE filed May 14, 2015 (Fitch et al.);

U.S. patent application Ser. No. 14/715,672 for AUGUMENTED REALITY ENABLED HAZARD DISPLAY filed May 19, 2015 (Venkatesha et al.);

U.S. patent application Ser. No. 14/715,916 for EVALUATING IMAGE VALUES filed May 19, 2015 (Ackley);

U.S. patent application Ser. No. 14/722,608 for INTERACTIVE USER INTERFACE FOR CAPTURING A DOCUMENT IN AN IMAGE SIGNAL filed May 27, 2015 (Showering et al.);

U.S. patent application Ser. No. 29/528,165 for IN-COUNTER BARCODE SCANNER filed May 27, 2015 (Oberpriller et al.);

U.S. patent application Ser. No. 14/724,134 for ELECTRONIC DEVICE WITH WIRELESS PATH SELECTION CAPABILITY filed May 28, 2015 (Wang et al.);

U.S. patent application Ser. No. 14/724,849 for METHOD OF PROGRAMMING THE DEFAULT CABLE INTERFACE SOFTWARE IN AN INDICIA READING DEVICE filed May 29, 2015 (Barten);

U.S. patent application Ser. No. 14/724,908 for IMAGING APPARATUS HAVING IMAGING ASSEMBLY filed May 29, 2015 (Barber et al.); U.S. patent application Ser. No. 14/725,352 for APPARATUS AND METHODS FOR MONITORING ONE OR MORE PORTABLE DATA TERMINALS (Caballero et al.);

U.S. patent application Ser. No. 29/528,590 for ELECTRONIC DEVICE filed May 29, 2015 (Fitch et al.);

U.S. patent application Ser. No. 29/528,890 for MOBILE COMPUTER HOUSING filed Jun. 2, 2015 (Fitch et al.);

U.S. patent application Ser. No. 14/728,397 for DEVICE MANAGEMENT USING VIRTUAL INTERFACES CROSS-REFERENCE TO RELATED APPLICATIONS filed Jun. 2, 2015 (Caballero);

U.S. patent application Ser. No. 14/732,870 for DATA COLLECTION MODULE AND SYSTEM filed Jun. 8, 2015 (Powilleit);

U.S. patent application Ser. No. 29/529,441 for INDICIA READING DEVICE filed Jun. 8, 2015 (Zhou et al.);

U.S. patent application Ser. No. 14/735,717 for INDICIA-READING SYSTEMS HAVING AN INTERFACE WITH A USER'S NERVOUS SYSTEM filed Jun. 10, 2015 (Todeschini);

U.S. patent application Ser. No. 14/738,038 for METHOD OF AND SYSTEM FOR DETECTING OBJECT WEIGHING INTERFERENCES filed Jun. 12, 2015 (Amundsen et al.);

U.S. patent application Ser. No. 14/740,320 for TACTILE SWITCH FOR A MOBILE ELECTRONIC DEVICE filed Jun. 16, 2015 (Bandringa);

U.S. patent application Ser. No. 14/740,373 for CALIBRATING A VOLUME DIMENSIONER filed Jun. 16, 2015 (Ackley et al.);

U.S. patent application Ser. No. 14/742,818 for INDICIA READING SYSTEM EMPLOYING DIGITAL GAIN CONTROL filed Jun. 18, 2015 (Xian et al.);

U.S. patent application Ser. No. 14/743,257 for WIRELESS MESH POINT PORTABLE DATA TERMINAL filed Jun. 18, 2015 (Wang et al.);

U.S. patent application Ser. No. 29/530,600 for CYCLONE filed Jun. 18, 2015 (Vargo et al);

U.S. patent application Ser. No. 14/744,633 for IMAGING APPARATUS COMPRISING IMAGE SENSOR ARRAY HAVING SHARED GLOBAL SHUTTER CIRCUITRY filed Jun. 19, 2015 (Wang);

U.S. patent application Ser. No. 14/744,836 for CLOUD-BASED SYSTEM FOR READING OF DECODABLE INDICIA filed Jun. 19, 2015 (Todeschini et al.);

U.S. patent application Ser. No. 14/745,006 for SELECTIVE OUTPUT OF DECODED MESSAGE DATA filed Jun. 19, 2015 (Todeschini et al.);

U.S. patent application Ser. No. 14/747,197 for OPTICAL PATTERN PROJECTOR filed Jun. 23, 2015 (Thuries et al.);

U.S. patent application Ser. No. 14/747,490 for DUAL-PROJECTOR THREE-DIMENSIONAL SCANNER filed Jun. 23, 2015 (Jovanovski et al.); and U.S. patent application Ser. No. 14/748,446 for CORDLESS INDICIA READER WITH A MULTIFUNCTION COIL FOR WIRELESS CHARGING AND EAS DEACTIVATION, filed Jun. 24, 2015 (Xie et al.).

In the specification and/or figures, typical embodiments of the invention have been disclosed. The present invention is not limited to such exemplary embodiments. The use of the term "and/or" includes any and all combinations of one or more of the associated listed items. The figures are schematic representations and so are not necessarily drawn to scale. Unless otherwise noted, specific terms have been used in a generic and descriptive sense and not for purposes of limitation.

The invention claimed is:

1. A spindle configured to receive rolled material on a core, the spindle comprising:

a shaft comprised of a rigid component and a flexible component, wherein the flexible component of the shaft is comprised of a plurality of flexible cantilevers configured to engage the core; and a plurality of hard stop features regularly spaced along an axis of the shaft, wherein each hard stop feature corresponds to a location of a free end of each of the plurality of flexible cantilevers.

2. The spindle of claim 1, wherein successive ones of the plurality of flexible cantilevers have alternating orientations.

3. The spindle of claim 2, further comprising a base, a free end of the one flexible cantilever nearest the base points in a first direction relative to the shaft and the free end of the successive one flexible cantilever points in a second direction relative to the shaft to define a pattern that repeats until the end of the shaft opposite the base.

4. The spindle of claim 1, wherein the plurality of flexible cantilevers are configured to hold the core in place on the spindle and adapt to a variation in core tolerance.

5. The spindle of claim 1, wherein a percentage of the shaft is comprised of the rigid component and a different percentage of the shaft is comprised of the flexible component.

6. The spindle of claim 1, wherein 50% of the shaft is comprised of the rigid component and the other 50% of the shaft is comprised of the flexible component.

7. The spindle of claim 1, wherein the spindle further comprises:

a plurality of buttresses spaced along the axis of the shaft with the flexible cantilevers.

8. The spindle of claim 7, wherein the plurality of buttresses are spaced between adjacent ones of the plurality of flexible cantilevers.

9. The spindle of claim 7, wherein the plurality of buttresses are regularly spaced along the axis of the shaft.

10. The spindle of claim 7, wherein the shaft and plurality of buttresses are made of the same material.

11. The spindle of claim 1, wherein the plurality of flexible cantilevers are made of a material configured to support tension and compression forces.

12. The spindle of claim 1, wherein the plurality of flexible cantilevers are a continuous part of a single flexible cantilever assembly.

13. The spindle of claim 1, wherein each of the plurality of the flexible cantilevers has a beveled edge on both ends of the surface of the flexible cantilever that is in contact with the core.

14. The spindle of claim 1, wherein the diameter of the spindle is equal to or less than 0.5 inches.

15. The spindle of claim 1, wherein the shaft and plurality of hard stop features are made of different materials.

16. The spindle of claim 1, wherein each of the plurality of hard stop features sets a maximum possible displacement for each corresponding flexible cantilever.

17. The spindle of claim 1, wherein each of the plurality of hard stop features prevents yielding of each corresponding flexible cantilever.

18. A spindle configured to receive rolled material on a core, the spindle comprising:

a shaft comprising:

a rigid component; and a flexible component comprising:

a plurality of flexible cantilevers configured to engage the core;

a plurality of buttresses positioned adjacent the plurality of flexible cantilevers; and a plurality of hard stop features spaced along an axis of the shaft, wherein each hard stop feature corresponds to a location of a free end of each of the plurality of flexible cantilevers.

19. A spindle configured to receive rolled material on a core, the spindle comprising:

a shaft comprising:

a rigid component; and a flexible component comprising:

a plurality of flexible cantilevers positioned along an axis of the shaft, wherein each flexible cantilever has a free end configured to engage the core; and a plurality of hard stop features positioned along the axis of the shaft, wherein each hard stop feature corresponds to a location of the free ends of the plurality of flexible cantilevers.

* * * * *